US010783843B2

(12) United States Patent
Li et al.

(10) Patent No.: US 10,783,843 B2
(45) Date of Patent: Sep. 22, 2020

(54) DISPLAY PANEL, DISPLAY APPARATUS AND DRIVING METHOD THEREOF

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Shuo Li, Beijing (CN); Zongze He, Beijing (CN); Zhenghua Lu, Beijing (CN); Yuxuan Chen, Beijing (CN); Jianguang Yang, Beijing (CN); Liang Zhang, Beijing (CN); Feng Long, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/360,908

(22) Filed: Mar. 21, 2019

(65) Prior Publication Data

US 2019/0295483 A1 Sep. 26, 2019

(30) Foreign Application Priority Data

Mar. 22, 2018 (CN) ..... 2018 1 0239181

(51) Int. Cl.
*G09G 3/36* (2006.01)

(52) U.S. Cl.
CPC ..... *G09G 3/3607* (2013.01); *G09G 3/3696* (2013.01); *G09G 2320/0626* (2013.01)

(58) Field of Classification Search
CPC ..... G09G 2320/0626; G09G 2310/08; G09G 3/3648; G09G 3/3607; G09G 2300/0426;
(Continued)

(56) References Cited

U.S. PATENT DOCUMENTS

2007/0008263 A1 1/2007 Kim
2010/0103339 A1 4/2010 Shimoshikiryoh et al.
(Continued)

FOREIGN PATENT DOCUMENTS

CN 1854831 A 11/2006
CN 101191914 A 6/2008
(Continued)

OTHER PUBLICATIONS

First Office Action issued in corresponding Chinese Application No. 201810239181.1, dated Dec. 18, 2019, with English translation.

*Primary Examiner* — Muhammad N Edun
(74) *Attorney, Agent, or Firm* — McDermott Will & Emery LLP

(57) ABSTRACT

A display panel includes a plurality of sub-pixels each corresponding one color. Each sub-pixel includes a plurality of display units and a plurality of driving sub-circuits that are in one-to-one correspondence with the plurality of display units. Each driving sub-circuit is configured to drive a corresponding one of the plurality of display units to be in a bright state or a dark state. The plurality of driving sub-circuits are configured to drive at least two of the plurality of display units to display different display brightness in the bright state.

15 Claims, 9 Drawing Sheets

(58) Field of Classification Search
CPC ..... G09G 2300/0452; G09G 3/3208; G09G 2300/0857; G09G 3/3685; G09G 2300/0443; G09G 3/3696
See application file for complete search history.

(56) References Cited

U.S. PATENT DOCUMENTS

| | | | | |
|---|---|---|---|---|
| 2010/0302131 | A1 | 12/2010 | Tsubata | |
| 2011/0242149 | A1 | 10/2011 | Yoshida et al. | |
| 2011/0273493 | A1 | 11/2011 | Yoshiga et al. | |
| 2013/0063499 | A1* | 3/2013 | Tanaka | G09G 3/3648 345/690 |
| 2013/0235060 | A1 | 9/2013 | Tamaki et al. | |
| 2014/0092080 | A1* | 4/2014 | Fukunaga | G09G 3/3696 345/212 |
| 2015/0325165 | A1* | 11/2015 | Mori | G09G 3/2025 345/698 |
| 2017/0092178 | A1* | 3/2017 | Lee | H01L 27/1225 |

FOREIGN PATENT DOCUMENTS

| | | | |
|---|---|---|---|
| CN | 101636690 | A | 1/2010 |
| CN | 101878448 | A | 11/2010 |
| CN | 102243834 | A | 11/2011 |
| CN | 102246222 | A | 11/2011 |
| CN | 103309068 | A | 9/2013 |
| KR | 10-2011-0067450 | A | 6/2011 |

* cited by examiner

DISPLAY PANEL, DISPLAY APPARATUS AND DRIVING METHOD THEREOF

CROSS-REFERENCE TO RELATED APPLICATION

This application claims priority to Chinese Patent Application No. 201810239181.1, submitted with Chinese Patent Office on Mar. 22, 2018, titled "DISPLAY PANEL, DISPLAY APPARATUS AND DRIVING METHOD THEREOF", which is incorporated herein by reference in its entirety.

TECHNICAL FIELD

The present disclosure relates to the field of display technologies, and more particularly, to a display panel, a display apparatus and a driving method of the display apparatus.

BACKGROUND

Liquid Crystal Display (LCD) apparatuses and Organic Light Emitting Diode (OLED) display apparatuses occupy leading positions in the present market of display apparatuses. The continuous developments of smart wearable technology and mobile application technology lead to higher request to the power consumption of the display apparatuses.

SUMMARY

In a first aspect, a display panel is provided. The display panel includes a plurality of sub-pixels each corresponding to one color. Each sub-pixel includes a plurality of display units and a plurality of driving sub-circuits that are in one-to-one correspondence with the plurality of display units. Each driving sub-circuit is configured to drive a corresponding one of the plurality of display units to be in a bright state or a dark state. The plurality of driving sub-circuits are configured to drive at least two of the plurality of display units to display different display brightness in the bright state.

In some embodiments, the plurality of display units includes at least three display units.

In some embodiments, the at least three display units are sequentially arranged along an extending direction of a gate line of the display panel. Alternatively, the at least three display units 11 are sequentially arranged along an extending direction of a data line of the display panel.

In some embodiments, display brightness of the at least three display units are different from each other in the bright state.

In some embodiments, ratios of areas of the at least three display units to an area of the sub-pixel are the same.

In some embodiments, display brightness of the at least three display units in the one sub-pixel are different in the bright state, and the at least three of the display units of the one sub-pixel have a same area proportion of the one sub-pixel.

In some embodiments, each display unit includes liquid crystals, and a pixel electrode and a common electrode which are configured to drive the liquid crystals, and common electrodes of display units of the display panel are electrically connected to each other.

In some embodiments, each driving sub-circuit includes a data input circuit and a storage circuit. The data input circuit is coupled to a gate line, a data line and the storage circuit, and a point on a connecting line between the data input circuit and the storage circuit is set as a first node. The data input circuit is configured to transmit a signal from the gate line to the first node under control of a signal from the gate line. The storage circuit is coupled to the first node, the gate line, a first voltage terminal, a second voltage terminal, a third voltage terminal, a fourth voltage terminal and a pixel electrode, and is configured to transmit a signal from the third voltage terminal or a signal from the fourth voltage terminal to the pixel electrode under controls of a signal from the first node, a signal from the gate line, a signal from the first voltage terminal and a signal from the second voltage terminal.

In some embodiments, the storage circuit includes a first latch circuit, a second latch circuit, a latch control circuit and a driving control circuit. The first latch circuit is coupled to the first node, the first voltage terminal, the second voltage terminal and the second latch circuit, and a point on a connecting line between the first latch circuit and the second latch circuit is set as a second node. The first latch circuit is configured to transmit a signal from the first voltage terminal or a signal from the second voltage terminal to the second node under control of a signal from the first node. The second latch circuit is coupled to the second node, the first voltage terminal, the second voltage terminal and the latch control circuit, and is configured to transmit a signal from the first voltage terminal or a signal from the second voltage terminal to the latch control circuit under control of a signal from the second node. The latch control circuit is further coupled to the gate line and the first node, and is configured to transmit a signal from the second latch circuit to the first node under control of a signal from the gate line. The driving control circuit is coupled to the first node, the second node, the third voltage terminal, the fourth voltage terminal and the pixel electrode, and is configured to transmit a signal from the fourth voltage terminal to the pixel electrode under control of a signal from the first node or transmit a signal from the third voltage terminal to the pixel electrode under control of a signal from the second node.

In some embodiments, the data input circuit includes a first transistor, a gate of the first transistor is coupled to the gate line, a gate of the first transistor is coupled to the gate line, a first electrode of the first transistor is coupled to the data line, and a second electrode of the first transistor is coupled to the first node.

In some embodiments, the latch control circuit includes a sixth transistor, a gate of the sixth transistor is coupled to the gate line, and a second electrode of the sixth transistor is coupled to the first node, wherein the first transistor and the sixth transistor are mutually N-type and P-type transistors.

In some embodiments, the first latch circuit includes a second transistor and a third transistor, and the second transistor and the third transistor are mutually N-type and P-type transistors. A gate of the second transistor is coupled to the first node, a first electrode of the second transistor is coupled to the first voltage terminal, and a second electrode of the second transistor is coupled to the second node. A gate of the third transistor is coupled to the first node, a first electrode of the third transistor is coupled to the second voltage terminal, and a second electrode of the third transistor is coupled to the second node.

In some embodiments, the second latch circuit includes a fourth transistor and a fifth transistor, and the fourth transistor and the fifth transistor are mutually N-type and P-type transistors. A gate of the fourth transistor is coupled to the second node, a first electrode of the fourth transistor is coupled to the first voltage terminal, and a second electrode of the fourth transistor is coupled to the first electrode of the sixth transistor. A gate of the fifth transistor is coupled to the second node, a first electrode of the fifth transistor is coupled to the second voltage terminal, and a second electrode of the fifth transistor is coupled to the first electrode of the sixth transistor.

In some embodiments, each driving sub-circuit is configured to drive a corresponding one of the plurality of display units to display one brightness in the bright state.

In a second aspect, a display apparatus is provided. The display apparatus includes the display panel described in the first aspect.

In a third aspect, a driving method for the display apparatus described in the second aspect is provided. The method includes: scanning sub-pixels of the display apparatus row by row; and inputting voltage signals that are not completely the same to fourth voltage terminals and data lines coupled to driving sub-circuits corresponding to display units in each sub-pixels of a row of sub-pixels in response to a scanning of the raw of sub-pixels, so that display brightness of at least two of the display units in the bright state are different.

In some embodiments, each display unit includes liquid crystals, and a pixel electrode and a common electrode which are configured to drive the liquid crystals. The driving method further comprises: inputting an alternating voltage to the common electrode, wherein a difference value between a voltage input from the third voltage terminal and the alternating voltage is 0; and inputting alternating voltages to fourth voltage terminals coupled to the driving sub-circuits respectively, wherein differences between the voltages input to the fourth voltage terminals and the alternating voltage of current input to the common electrode are not completely equal.

BRIEF DESCRIPTION OF THE DRAWINGS

In order to more clearly describe technical solutions of embodiments of the present disclosure, the drawings used in the description of the embodiments will be briefly introduced below. Obviously, the drawings in the following description are only some embodiments of the present disclosure, and for those persons skilled in the art, without paying any creative effort, other drawings are also obtained according to these drawings.

DETAILED DESCRIPTION

The technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Memory in Pixel (MIP) technology has broad prospects in the display field because it has characteristics such as simple structure and low cost without changing LCD processes and developing new materials. By using MIP technology, built-in storage circuits of pixels in a display panel may automatically store and update display image data. When a display image is updated at a lower frequency, updated frequencies of pixels in the display panel are lower, thereby reducing the power consumption required by the display panel.

However, in the related art, in the products (e.g., the products including sub-pixels of three primary colors) using a MIP LCD display technology, one sub-pixel may only display one kind of brightness in a bright state, and one sub-pixel may only be in only two states, i.e., the bright state and a dark state. For a pixel including three sub-pixels in a product, it may only achieve transformations for eight colors (2×2×2). In this way, products using MIP LCD display technology have fewer display colors, and thus the products have low color performance.

Figure 1A:
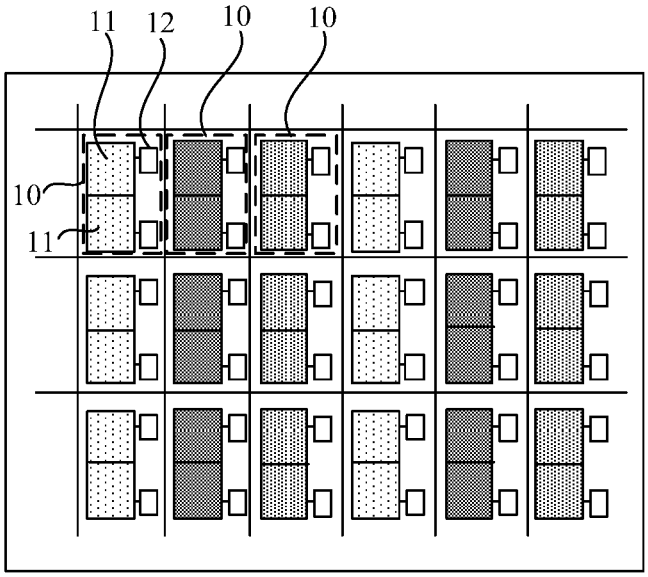
FIG. 1A is a schematic diagram showing a structure of a display panel in accordance with some embodiments of the present disclosure.
Figure 1B:
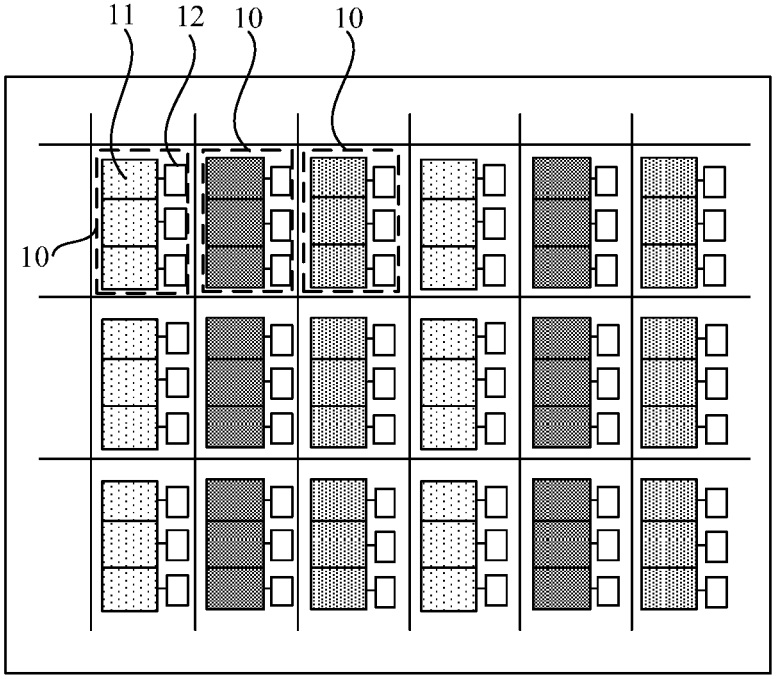
FIG. 1B is a schematic diagram showing a structure of another display panel in accordance with some embodiments of the present disclosure.

Some embodiments of the present disclosure provide a display panel, and as shown in FIGS. 1A and 1B, the display panel includes a plurality of sub-pixels 10 each corresponding to one color. Each sub-pixel 10 includes a plurality of display units 11 and a plurality of driving sub-circuits 12 that are in one-to-one correspondence with the plurality of display units 11. Each driving sub-circuit 12 is configured to drive a corresponding one of the plurality of display units 11 to be in a bright state or a dark state, and the plurality of driving sub-circuit 12 are configured to drive at least two display units of the plurality of display units 11 to display different display brightness in the bright state, so that the at least two display units display a same color with different brightness.

The bright state herein refers to a state in which light is emitted from the display unit. The dark state herein refers to a state in which no light is emitted from the display unit. In some examples, the brightness herein is 0 in the dark state. In some embodiments, each driving sub-circuit 12 is configured to drive a corresponding one of the plurality of display units 11 to display one brightness in the bright state.

In some embodiments, the plurality of sub-pixels 10 of the display panel include sub-pixels that configured to display three primary colors, and the plurality of display units of each sub-pixel display the same color. Alternatively, the plurality of sub-pixels 10 further include sub-pixels that display white. Of course, the constitution of the plurality of sub-pixels is not limited to the above situations herein.

The three primary colors are red, blue and green. For example, a first primary color is red, a second primary color is green, and a third primary color is blue. Alternatively, the three primary colors are cyan, magenta and yellow. For example, the first primary color is cyan, the second primary color is magenta, and the third primary color is yellow. Of course, the three primary colors may be other colors, which may be set according to actual requirements.

In some embodiments, in the display panel shown in FIG. 1A, each pixel includes three sub-pixels 10. Each sub-pixel 10 includes two display units 11, and the two display units have different display brightness, such as brightness a1 and a2 respectively, in the bright state. In this way, the sub-pixel 10 may achieve transformations of four kinds of brightness, and one pixel may achieve transformations of 64 colors (4×4×4).

Four kinds of brightness that sub-pixel 10 may achieve are as follows.

Gray level 0: G1 and G2 are in the dark state.

Gray level 1: G1 is in the bright state, and G2 is in the dark state.

Gray level 2: G2 is in the bright state, and G1 is in the dark state.

Gray level 3: G1 and G2 are in the bright state.

In some other embodiments, as shown in FIG. 1B, the display panel includes a plurality of pixels, and each pixel includes three sub-pixels 10. Each sub-pixel includes at least three display units 11 and at least three driving sub-circuits 12 that are in one-to-one correspondence with the at least three display units 11. Each driving sub-circuit 12 is configured to drive a corresponding display unit 11 to be in a bright state or a dark state, and the at least three driving sub-circuits 12 are configured to drive at least two display units 11 of the at least three display units 11 to display different display brightness in the bright state.

It is only some examples that one sub-pixel 10 shown in FIG. 1A and FIG. 1B includes two display units 11 or three display units 11. The number of the display units included in one sub-pixel 10 is not limited to two or three herein, and may also be more than three.

Each display unit 11 corresponds to a driving sub-circuit 12, and the plurality of display units 11 of each sub-pixel 10 display independently under driving of the plurality of driving sub-circuits 12

In some embodiments, sizes of the plurality of display units 11 are the same. Alternatively, sizes of the plurality of display units 11 are different.

The description "at least two display units 11 of the at least three display units 11 display different display brightness in the bright state" refers to that any two of the at least three display units 11 display different display brightness in the bright state, or the display brightness of the at least three display units 11 in the bright state are different from each other.

By taking any pixel including three sub-pixels in the display panel as an example, the gray levels of the pixel are described in detail below.

Figure 2:
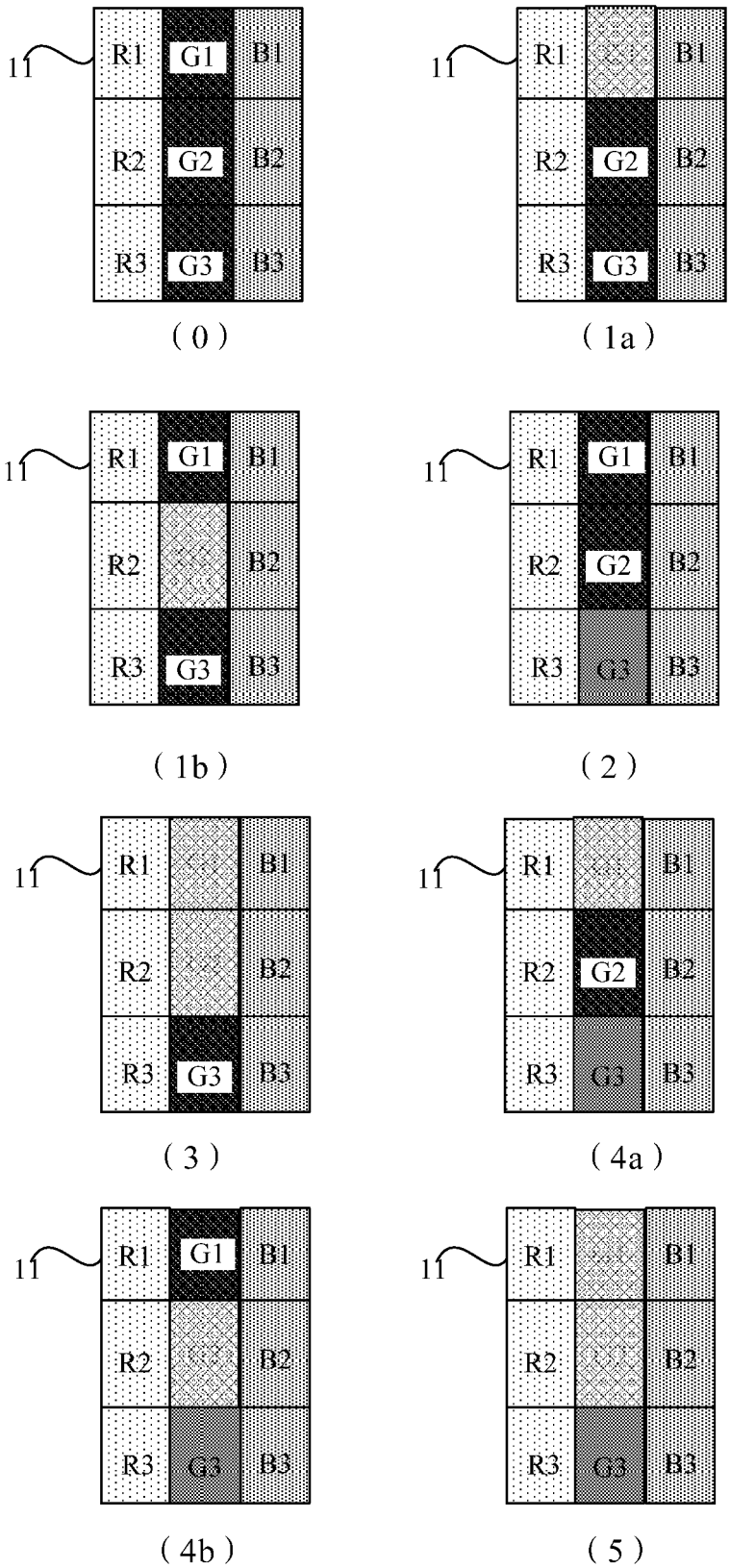
FIG. 2 is a schematic diagram showing gray levels of a sub-pixel in accordance with some embodiments of the present disclosure.

In some embodiments, each pixel includes three sub-pixel 10, and each sub-pixel 10 shown in FIG. 2 includes three display units 11, two of which have different display brightness in the bright state. Taking a sub-pixel configured to display only green as an example, the sub-pixel 10 includes three display units G1, G2 and G3. The display units G1 and G2 have the same display brightness, such as brightness a3, in the bright state, and display brightness, such as brightness a4, of the display unit G3 is different from those of the display units G1 and G2 in the bright state. The sub-pixel configured to display green may display six gray levels, as shown in (0) to (5) of FIG. 2.

Gray level 0: G1, G2 and G3 are in the dark state.

Gray level 1: G1 (G2) is in the bright state, and G2 (G1) and G3 are in the dark state.

Gray level 2: G3 is in the bright state, and G1 and G2 are in the dark state.

Gray level 3: G1 and G2 are in the bright state, and G3 is in the dark state.

Gray level 4: G1 (G2) and G3 are in the bright state, G2 (G1) is in the dark state.

Gray level 5: G1, G2 and G3 are in the bright state.

In this way, the sub-pixel can display six gray levels, and the pixel can display 6×6×6=216 colors.

Figure 3:
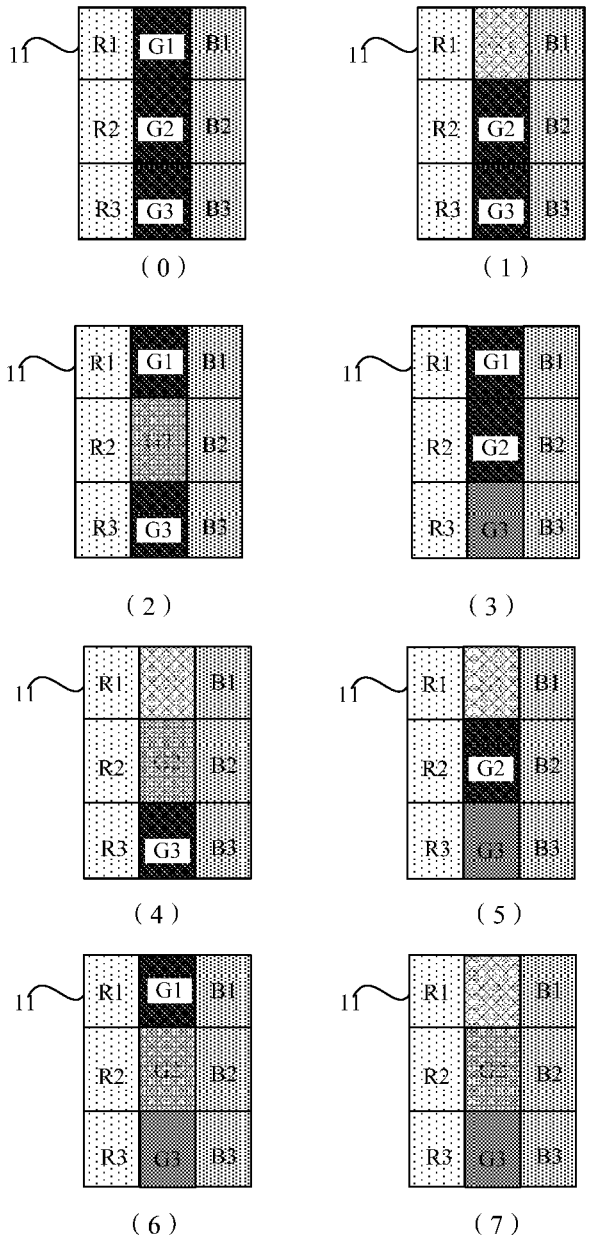
FIG. 3 is a schematic diagram showing gray levels of another sub-pixel in accordance with some embodiments of the present disclosure.

In some embodiments, each sub-pixel 10 shown in FIG. 3 includes three display units 11, and display brightness of the three display units are different from each other in the bright state. Taking a sub-pixel configured to display green as an example, the display brightness of three display units G1, G2, G3 included in the sub-pixel in the bright state are different from each other, and the sub-pixel can display eight gray levels, as shown in (0) to (7) of FIG. 3.

The display brightness of the display units G1, G2, and G3 in the bright state is shown in (7) of FIG. 3.

Gray level 0: G1, G2 and G3 are in the dark state.

Gray level 1: G1 is in the bright state, and G2 and G3 are in the dark state.

Gray level 2: G2 is in the bright state, and G1 and G3 are in the dark state.

Gray level 3: G3 is in the bright state, and G1 and G2 are in the bright state.

Gray level 4: G1 and G2 are the bright state, and G3 is the dark state.

Gray level 5: G1 and G3 are in the bright state, and G2 is in the dark state.

Gray level 6: G2 and G3 are in the bright state, and G1 is in the dark state.

Gray level 7: G1, G2 and G3 are in the bright state.

In this way, the sub-pixel can display eight gray levels, and the pixel can display 8×8×8=512 colors.

In the display panel provided by some embodiments of the present disclosure, the sub-pixel 10 is divided into the plurality of display units 11 and each display unit 11 is driven independently by a corresponding driving sub-circuit 12, so that the display brightness of the plurality of display units 11 in the bright state are controlled to be not completely the same, thereby increasing the number of gray levels that the sub-pixels 10 may display. In this way, any pixel of the display panel may display at least 216 colors, which greatly increases the number of the display colors of the product adopting the MIP LCD display technology, and enhance the color performances of the product.

Figure 4:
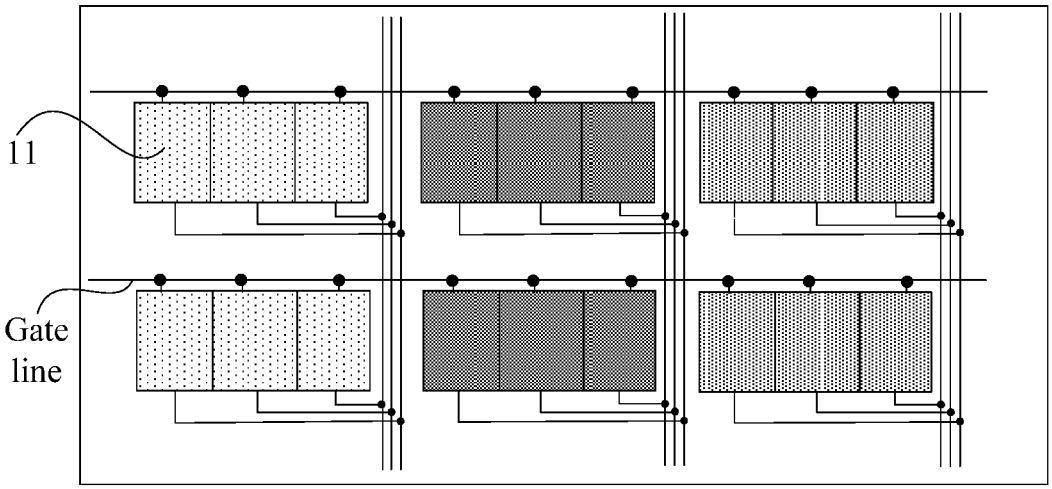
FIG. 4 is a schematic diagram showing an arrangement of display units in the display panel shown in FIG. 1B in accordance with some embodiments of the present disclosure.

In some embodiments, as shown in FIG. 4, the at least three display units 11 are sequentially arranged along an extending direction of a gate line of the display panel.

Since the at least three display units 11 in one sub-pixel 10 are simultaneously driven during display, sequentially arranging the at least three display units 11 along the extending direction of the gate line of the display panel may reduce the number of gate lines in the display panel. In this situation, one gate line drives all of the display units 11 in one row of sub-pixels.

Figure 5:
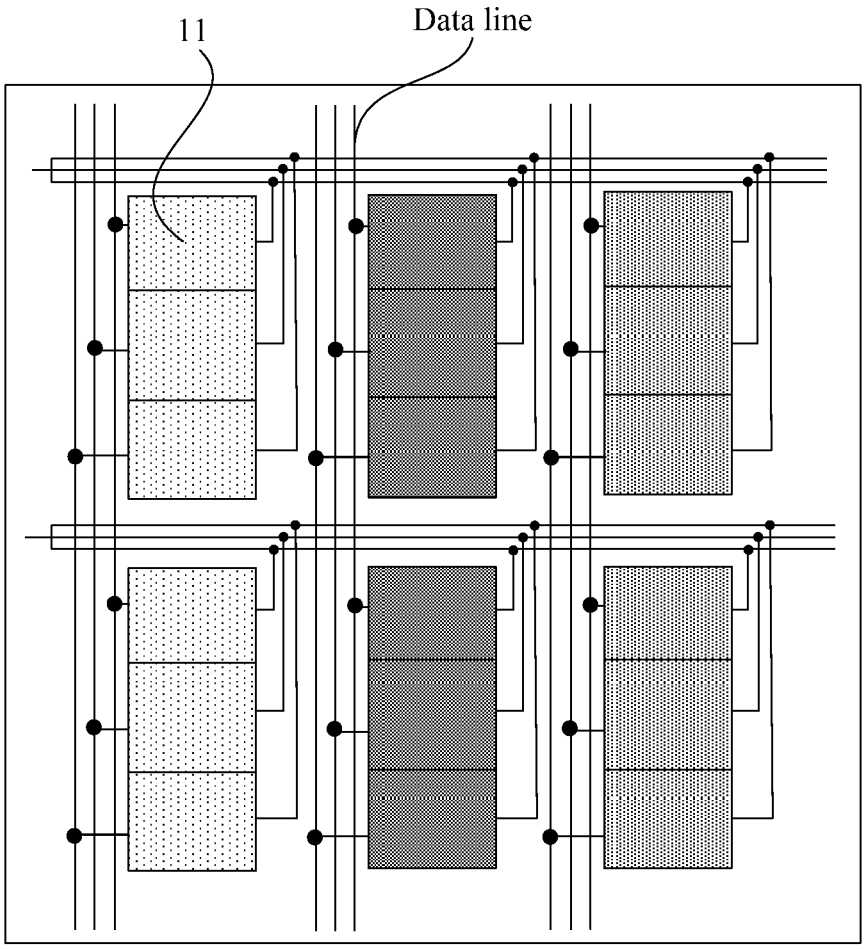
FIG. 5 is a schematic diagram showing another arrangement of display units in the display panel shown in FIG. 1B in accordance with some embodiments of the present disclosure.

In some embodiments, as shown in FIG. 5, the at least three display units 11 are sequentially arranged along an extending direction of a data line of the display panel.

During display, the at least three display units 11 in one sub-pixel 10 are driven simultaneously, and the at least three display units 11 are respectively input gate driving signals at the same time. FIG. 5 illustrates that three display units 11 in one sub-pixel 10 are driven by three gate lines respectively, and a group of display units 11 in a row of sub-pixels 10 are driven by one gate line. The three gate lines may be coupled to one signal terminal, or may be respectively coupled to signal terminals. Of course, the number of gate lines may be reduced by rationally designing paths of the gate lines.

Figure 6:
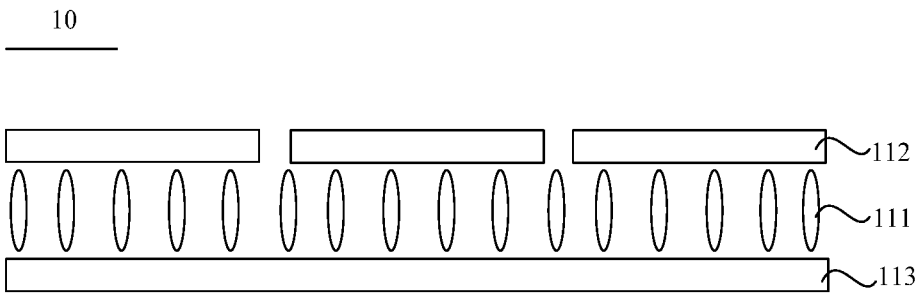
FIG. 6 is a schematic diagram showing cross-sectional structures of display units in accordance with some embodiments of the present disclosure.

FIG. 6 is a schematic diagram showing a cross-sectional structure of one sub-pixel in the display panel according to some embodiments of the present disclosure. In the sub-pixel, in order to increase the number of display colors of the display panel, the display brightness of the at least three display units 11 of the sub-pixel 10 in the bright state are different from each other.

In order to improve display effects, as shown in FIG. 6, ratios of areas of the at least three display units 11 of the sub-pixel 10 to an area of the sub-pixel 10 are the same. That is, the sub-pixel 10 is divided into the at least three display units 11, and the at least three display units 11 have the same area.

As shown in FIG. 6, each display unit 11 includes liquid crystals 111, and a pixel electrode 112 and a common electrode 113 which are configured to drive the liquid crystals 111. Common electrodes 113 of display units 11 in the display panel are electrically connected to each other.

That is, one sub-pixel 10 includes pixel electrodes which are supplied different signals respectively. Thus, the display units 11 may be controlled to display different brightness. Structures of the display units 11 are the same as those of the sub-pixels in the related art, and the structure of the sub-pixel in FIG. 6 is only illustrative.

Figure 7:
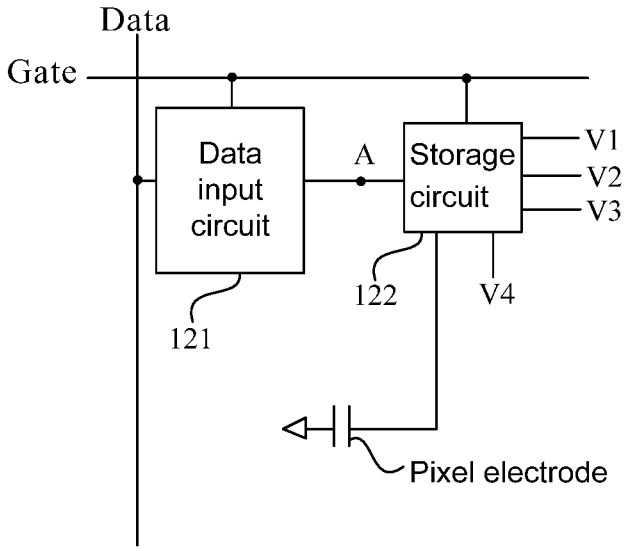
FIG. 7 is a schematic diagram showing a structure of a driving sub-circuit in the display panel shown in FIG. 1A or 1B in accordance with some embodiments of the present disclosure.

As shown in FIG. 7, in some embodiments, the driving sub-circuit 12 includes a data input circuit 121 and a storage circuit 122.

The data input circuit 121 is coupled to a gate line Gate, a data line Data, and the storage circuit 122. For convenience of description, a first node A is introduced, and the first node A is a point on a connecting line between the data input circuit 121 and the storage circuit 122. The data input circuit 121 is configured to transmit a signal from the data line Data to the first node A under control of a signal from the gate line Gate.

The storage circuit 122 is coupled to the first node A, the gate line Gate, a first voltage terminal V1, a second voltage terminal V2, a third voltage terminal V3, a fourth voltage terminal V4, and a pixel electrode. The storage circuit 122 is configured to transmit a signal from the third voltage terminal V3 or a signal from the fourth voltage terminal V4 to the pixel electrode under controls of signals from the first node A, the gate line Gate, the first voltage terminal V1 and the second voltage terminal V2.

The driving sub-circuits 12 respectively coupled to display units 11 include storage circuits 122, and make the display units 11 to maintain a display of a current screen under actions of the storage circuits 122 in a state where the data lines Data do not transmit new signals, so that the display panel has a pixel self-refresh function to achieve low-speed driving of data transmission, and a refresh frequency may be reduced to 1 Hz, which reduces the power consumption of the display panel.

Figure 8:
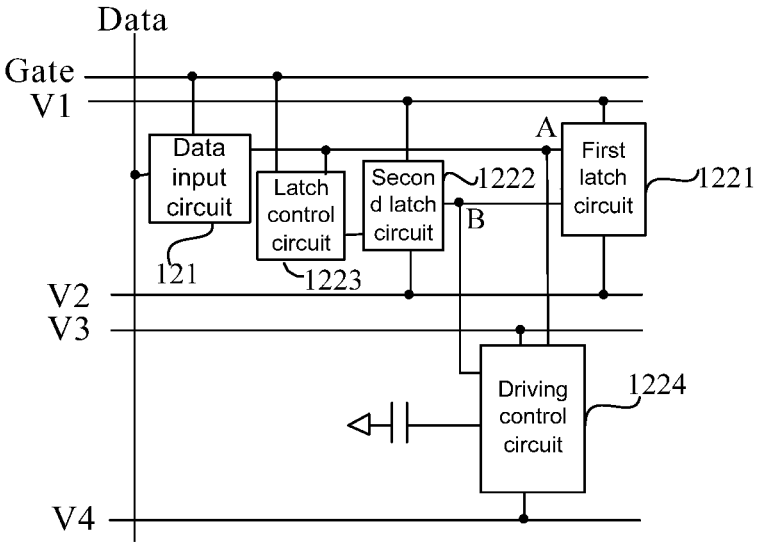
FIG. 8 is a schematic diagram showing a structure of another driving sub-circuit of the display panel shown in FIG. 1A or 1B in accordance with some embodiments of the present disclosure.

As shown in FIG. 8, the storage circuit 122 includes a first latch circuit 1221, a second latch circuit 1222, a latch control circuit 1223, and a driving control circuit 1224.

The first latch circuit 1221 is coupled to the first node A, the first voltage terminal V1, the second voltage terminal V2 and the second latch circuit 1222. For convenience of description, a second node B is introduced, and the second node B is a point on a connecting line between the first latch circuit 1221 and the second latch circuit 1222. The first latch circuit 1221 is configured to transmit a signal from the first voltage terminal V1 or a signal from the second voltage terminal V2 to the second node B under control of a signal from the first node A.

The second latch circuit 1222 is coupled to the second node B, the first voltage terminal V1, the second voltage terminal V2 and the latch control circuit 1223, and is configured to transmit the signal from a first voltage terminal V1 or a signal from the second voltage terminal V2 to the latch control circuit 1223 under control of a signal from the second node B.

The latch control circuit 1223 is further coupled to the gate line Gate and the first node A, and is configured to transmit the signal from the second latch circuit 1222 to the first node A under control of a signal from the gate line Gate.

The driving control circuit 1224 is coupled to the first node A, the second node B, the third voltage terminal V3, the fourth voltage terminal V4 and the pixel electrode, and is configured to transmit a signal from the fourth voltage terminal V4 to the pixel electrode under control of a signal from the first node A or transmit a signal from the third voltage terminal V3 to the pixel electrode under the control of a signal from the second node B.

Figure 9:
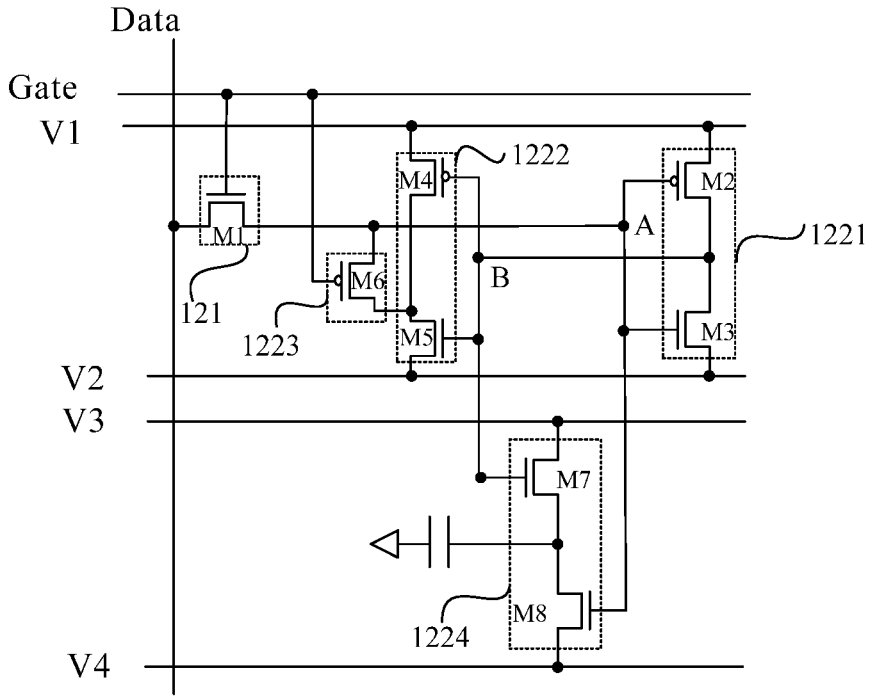
FIG. 9 is a schematic diagram showing a structure of the driving sub-circuit shown in FIG. 8 in accordance with some embodiments of the present disclosure.

FIG. 9 shows a circuit structure of the driving sub-circuit of FIG. 8 according to some embodiments of the present disclosure. As shown in FIG. 9, in some embodiments, the data input circuit 121 includes a first transistor M1. A gate of the first transistor M1 is coupled to the gate line Gate, a first electrode of the first transistor M1 is coupled to the data line Data, and a second electrode of the first transistor M1 is coupled to the first node A.

It will be noted that the data input circuit may include a plurality of first transistors M1 connected in parallel. The above is only an example of the data input circuit, and other structures having the same functions as the data input circuit are not described herein, but all should belong to the protection scope of the present disclosure.

As shown in FIG. 9, in some embodiments, the first latch circuit 1221 includes a second transistor M2 and a third transistor M3. A gate of the second transistor M2 is coupled to the first node A, a first electrode of the second transistor M2 is coupled to the first voltage terminal V1, and a second electrode of the second transistor M2 is coupled to the second node B. A gate of the third transistor M3 is coupled to the first node A, a first electrode of the third transistor M3 is coupled to the second voltage terminal V2, and a second electrode of the third transistor M3 is coupled to the second node B.

It will be noted that the first latch circuit 1221 may further include a plurality of switching transistors connected in parallel with the second transistor M2, and/or a plurality of switching transistors connected in parallel with the third transistor M3. The above is only an example of the first latch circuit 1221, and other structures having the same functions as the first latch circuit 1221 are not described herein, but all should belong to the protection scope of the present disclosure.

As shown in FIG. 9, in some embodiments, the second latch circuit 1222 includes a fourth transistor M4 and a fifth transistor M5. A gate of the fourth transistor M4 is coupled to the second node B, a first electrode of the fourth transistor M4 is coupled to the first voltage terminal V1, and a second electrode of the fourth transistor M4 is coupled to the latch control circuit 1223. A gate of the fifth transistor M5 is coupled to the second node B, a first electrode of the fifth transistor M5 is coupled to the second voltage terminal V2, and a second electrode of the fifth transistor M5 is coupled to the latch control circuit 1223.

It will be noted that the second latch circuit 1222 may further include a plurality of switching transistors connected in parallel with the fourth transistor M4, and/or a plurality of switching transistors connected in parallel with the fifth transistor M5. The above is only an example of the second latch circuit 1222, and other structures having the same functions as the second latch circuit 1222 are not described herein, but all should belong to the protection scope of the present disclosure.

As shown in FIG. 9, in some embodiments, the latch control circuit 1223 includes the sixth transistor M6. A gate of the sixth transistor M6 is coupled to the gate line Gate, a first electrode of the sixth transistor M6 is coupled to the second electrode of the fourth transistor M4 and the second electrode of the fifth transistor M5, and a second electrode of the sixth transistor M6 is coupled to the first node A.

It will be noted that the latch control circuit 1223 may further include a plurality of switching transistors connected in parallel with the sixth transistor. The above is only an example of the latch control circuit 1223, and other structures having the same functions as the latch control circuit 1223 are not described herein, but all should belong to the protection scope of the present disclosure.

As shown in FIG. 9, in some embodiments, the driving control circuit 1224 includes a seventh transistor M7 and a eighth transistor M8. A gate of the seventh transistor M7 is coupled to the second node B, a first electrode of the seventh transistor M7 is coupled to the third voltage terminal V3, and a second electrode of the seventh transistor M7 is coupled to the pixel electrode. A gate of the eighth transistor M8 is coupled to the first node A, a first electrode of the eighth transistor M8 is coupled to the fourth voltage terminal V4, and a second electrode of the eighth transistor M8 is coupled to the pixel electrode.

It will be noted that the driving control circuit 1224 may further include a plurality of switching transistors connected in parallel with the seventh transistor M7, and/or a plurality of switching transistors connected in parallel with the eighth transistor M8. The above is only an example of the driving control circuit 1224, and other structures having the same functions as the driving control circuit 1224 are not described herein, but all should belong to the protection scope of the present disclosure.

It will be noted that the first transistor M1 and the sixth transistor M6, the second transistor M2 and the third transistor M3, as well as the fourth transistor M4 and the fifth transistor M5 are mutually N-type and P-type transistors. That is to say, when the first transistor M1, the third transistor M3 and the fifth transistor M5 are N-type transistors, the second transistor M2, the fourth transistor M4, and the sixth transistor M6 are P-type transistors. Alternatively, when the first transistor M1, the third transistor M3, and the fifth transistor M5 are P-type transistors, the second transistor M2, the fourth transistor M4, and the sixth transistor M6 are N-type transistors. N-type transistor is turned on in response to a high level, and is cut off in response to a low level, whereas P-type transistor is just the opposite.

In some examples, the first electrodes of above transistors are drains and the second electrodes are sources. Alternatively, the first electrodes are sources, and the second electrodes are drains.

In addition, the transistors in the above pixel circuit may be divided into enhancement type transistors and depletion type transistors according to different conductivity manners of the transistors.

In some embodiments, as shown in FIG. 9, the second transistor M2, the fourth transistor M4 and the sixth transistor M6 are P-type transistors, and the other transistors are N-type transistors. A high level VDD is input via the first voltage terminal V1, and a low level VSS is input via the second voltage terminal V2 or the second voltage terminal V2 is grounded. A voltage difference between a signal input via the third voltage terminal V3 and a signal Vcom on the common electrode is 0V (so that the display unit 11 is in the dark state). A driving signal is input via the fourth voltage terminal V4 (so that the display unit 11 is in the bright state). Signals input via the fourth voltage terminals V4 coupled to different display units 11 are not completely the same. High and low here only indicate a relative magnitude relationship between the voltages input.

Based on the above description for the structure of the driving sub-circuit, a process of driving the above driving sub-circuit will be described in detail below with reference to FIGS. 10 to 14.

Figure 11:
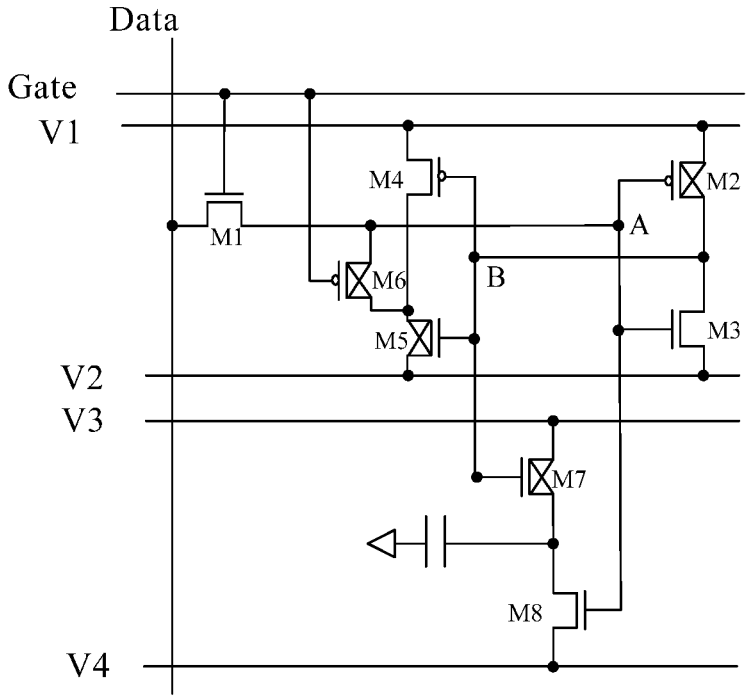
FIGS. 11 to 14 are equivalent circuit diagrams of the driving sub-circuit shown in FIG. 8.

In a case where the display unit 11 is in the bright state, the gate line Gate inputs a signal in a high level, and the data line Data inputs a signal in a high level. Based on this, an equivalent circuit diagram of the driving sub-circuit shown in FIG. 9 is shown in FIG. 11. The first transistor M1 is turned on, and the signal in the high level from the data line Data is transmitted to the first node A to control the eighth transistor M8 to be turned on, thereby transmitting the driving signal from the fourth voltage terminal V4 to the pixel electrode. Liquid crystals are driven by a difference value between voltages of the pixel electrode and the common electrode, so as to control the display unit 11 to be in the bright state (the transistor in the cut-off state is indicated by the symbol "x").

Figure 12:
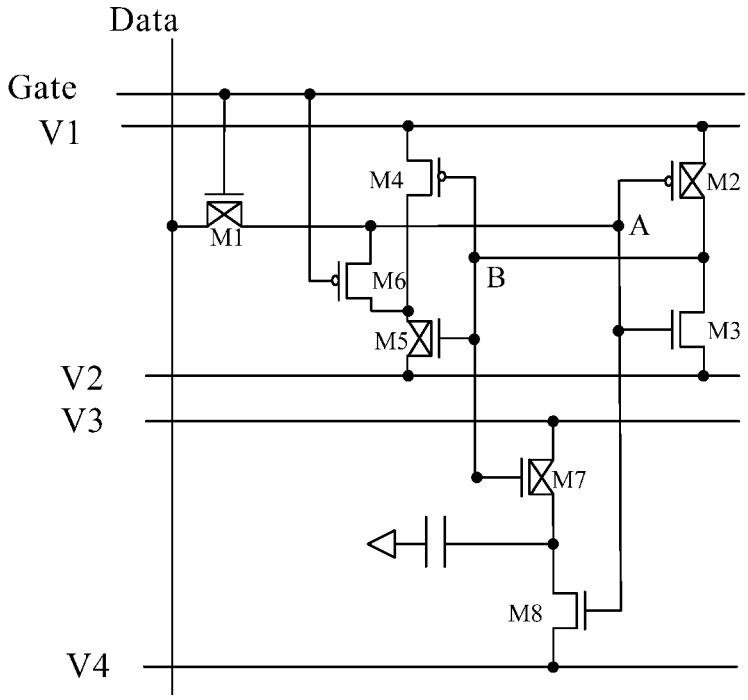

Subsequently, the gate line Gate and the data line Data input signals in a low level. Based on this, an equivalent circuit diagram of the driving sub-circuit shown in FIG. 9 is as shown in FIG. 12. The sixth transistor M6 is turned on, and the third transistor M3 is turned on in response to a signal in the high level from the first node A. A signal in the low level from the second voltage terminal V2 is transmitted to the second node B via the third transistor M3 to control the fourth transistor M4 to be turned on. A signal in the high level from the first voltage terminal V1 is transmitted to the first node A via the fourth transistor M4 and sixth transistor M6, thereby controlling the eighth transistor M8 to maintain turning on, so that the display unit 11 remains in the bright state.

Figure 13:
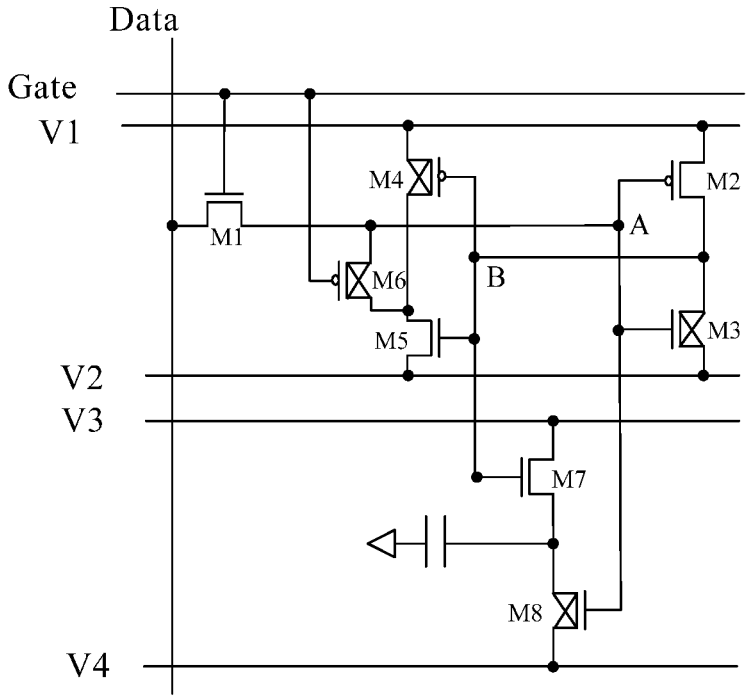

In a case where the display unit 11 is in the dark state, the gate line Gate inputs a signal in the high level, and the data line Data inputs a signal in the low level. Based on this, an equivalent circuit diagram of the driving sub-circuit shown in FIG. 9 is as shown in FIG. 13. The first transistor M1 is turned on, and the signal in the low level from the data line Data is transmitted to the first node A to control the second transistor M2 to be turned on. A signal in the high level from the first voltage terminal V1 is transmitted to the second node B via the second transistor M2 to control the seventh transistor M7 to be turned on. A signal from the third voltage terminal V3 is transmitted to the pixel electrode via the seventh transistor M7, and a voltage difference between the pixel electrode and the common electrode is 0V, so as to control the display unit 11 to be in the dark state.

Figure 14:
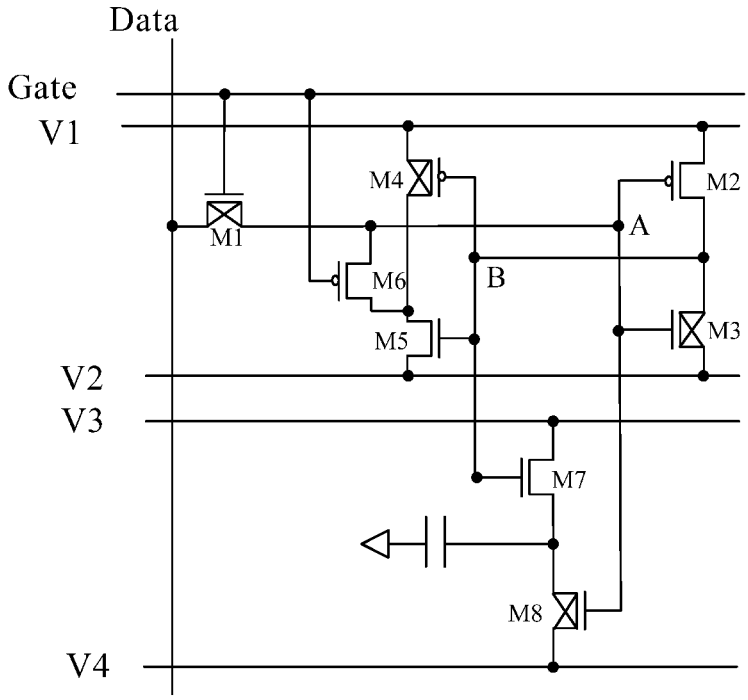

Then, the gate line Gate and the data line Data input signals in the low level. Based on this, an equivalent circuit diagram of the driving sub-circuit shown in FIG. 9 is as shown in FIG. 14. The sixth transistor M6 is turned on, and the fifth transistor M5 is turned on in response to the high level from the second node B. A signal in the low level from the second voltage terminal V2 is transmitted to the first node A via the fifth transistor M5 and the sixth transistor M6, so that the second transistor M2 and the seventh transistor M7 are maintained turning on, so as to control the display unit 11 to remain in the dark state.

Figure 10:
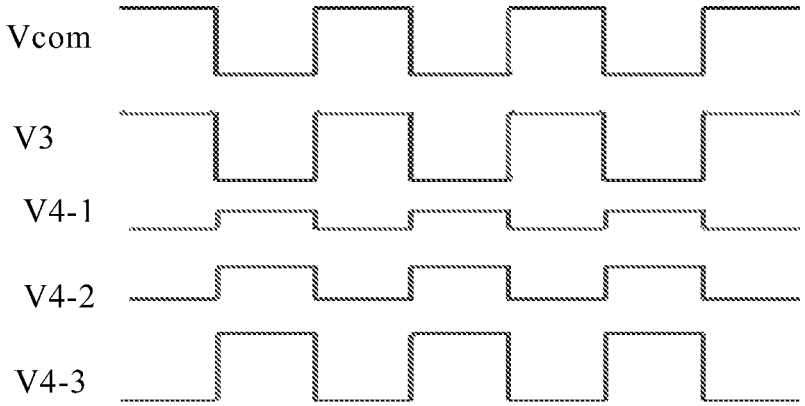
FIG. 10 is a timing diagram of signals used when the driving sub-circuit shown in FIG. 8 are driven.

As shown in FIG. 10, the voltages of the fourth voltage terminals V4 of the three display units 11 are respectively represented by V4-1, V4-2, and V4-3, and the voltages input via the fourth voltage terminals V4 are different. Therefore, the brightness displayed by the display units are different.

In some embodiments, the first voltage terminals V1, the second voltage terminals V2, the third voltage terminals V3, and the gate lines Gate coupled to the plurality of driving sub-circuits 12 corresponding to the plurality of display units 11 in one sub-pixel 10 are coupled to respective same voltage terminals, and the fourth voltage terminals V4 and data lines Data are coupled to different voltage terminals.

That is, the signals received by the first voltage terminals V1 of the plurality of driving sub-circuits 12 in each sub-pixel 10 are the same and synchronized. Therefore, in order to simplify the circuit structure, these first voltage terminals V1 may be coupled to one voltage terminal. Similarly, the second voltage terminals V2 of the plurality of driving sub-circuits 12 in each sub-pixel 10 may be coupled to one voltage terminal. The third voltage terminals V3 of the plurality of driving sub-circuits 12 in each sub-pixel 10 may be coupled to one voltage terminal. The gate lines Gate coupled to the plurality of driving sub-circuits 12 in each sub-pixel 10 may be coupled to one signal terminal. The data line Data of each driving sub-circuit 12 independently transmits signals, and the fourth voltage terminal V4 also independently transmits signals.

Figure 15:
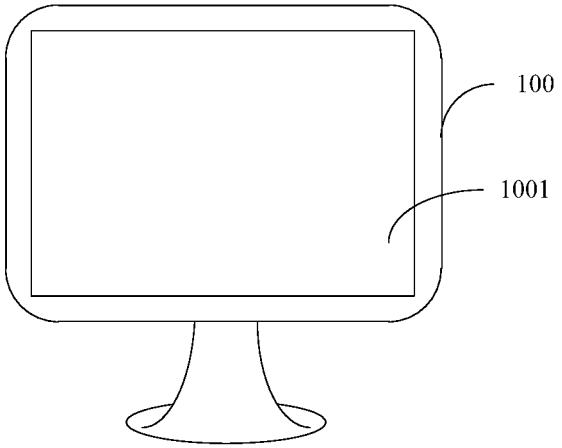
FIG. 15 is a schematic diagram of a display apparatus in accordance with some embodiments of the present disclosure.

As shown in FIG. 15, some embodiments of the present disclosure provide a display apparatus, which includes the display panel described in the above embodiments. For example, the display apparatus 100 includes a display panel 1001. The display apparatus 100 may also include other suitable structures, such as back lights, driving boards, bezels, and the like. The display apparatus 100 may be any product or component having display function such as an electronic paper, a mobile phone, a wearable device, a sporting watch, a tablet computer, a television, a display, a notebook computer, a digital photo frame, a navigator, etc.

The beneficial effects of the display apparatus provided in some embodiments of the present disclosure are the same as those of the above display panel, and are not described herein again.

Figure 16:
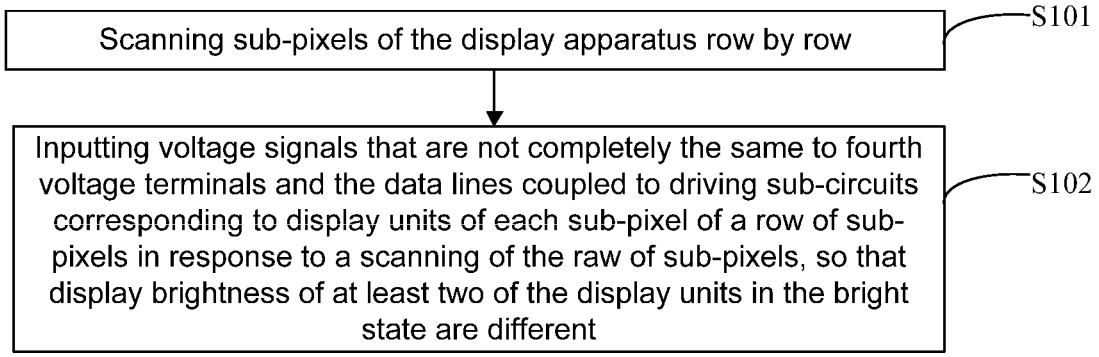
FIG. 16 is a flow chart of a driving method for the display apparatus in accordance with some embodiments of the present disclosure.

Some embodiments of the present disclosure provide a driving method for the display apparatus described in the above embodiments. As shown in FIG. 16, the method includes S101-S102.

In S101, sub-pixels 10 of the display apparatus are scanned row by row.

In S102, voltage signals that are not completely the same are respectively input to fourth voltage terminals V4 and data lines Data coupled to driving sub-circuits 12 corresponding to display units 11 in each sub-pixel of a row of sub-pixels 10 in response to a scanning of the raw of sub-pixels, so that the display brightness of at least two of the display units 11 in the bright state are different.

In this way, for each sub-pixel 10, by inputting a driving signal to each display unit 11 in each sub-pixel of the row of sub-pixels 10, different display units 11 are controlled to display different brightness, so that the sub-pixels 10 display an image according to preset gray levels. Each sub-pixel 10 has more gray levels, which makes the display apparatus more colorful.

Better color performance may be achieved by combining the display apparatus having special structures of sub-pixels 10 provided by some embodiments of the present disclosure with special driving waveforms.

As shown in FIG. 10, the method further includes the following step.

An alternating voltage is input to the common electrode 113, and a difference between a voltage input from the third voltage terminal V3 and the alternating voltage is 0. In addition, alternating voltages are input to fourth voltage terminals V4 coupled to the driving sub-circuits 12 respectively, and differences between the voltages input to the fourth voltage terminals V4 and the alternating voltage are not completely equal.

The third voltage terminal V3 may be coupled to a signal terminal via which signals are input to the common electrode 113.

In addition, by inputting the alternating voltage to the common electrode 113, a variation of the voltage difference between the pixel electrode 112 and the common electrode 113 is reduced, and the power consumption may be further reduced.

The foregoing descriptions are merely some implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A display panel, comprising a plurality of sub-pixels each corresponding to one color, each sub-pixel including a plurality of display units and a plurality of driving sub-circuits that are in one-to-one correspondence with the plurality of display units, wherein each driving sub-circuit is configured to drive a corresponding one of the plurality of display units to be in a bright state or a dark state, and the plurality of driving sub-circuits are configured to drive at least two of the plurality of display units to display different display brightness in the bright state;

each driving sub-circuit includes a data input circuit and a storage circuit;

the data input circuit is coupled to a gate line, a data line and the storage circuit, a point on a connecting line between the data input circuit and the storage circuit is set as a first node, and the data input circuit is configured to transmit a signal from the gate line to the first node under control of a signal from the gate line; and the storage circuit is coupled to the first node, the gate line, a first voltage terminal, a second voltage terminal, a third voltage terminal, a fourth voltage terminal and a pixel electrode, and is configured to transmit a signal from the third voltage terminal or a signal from the fourth voltage terminal to the pixel electrode under controls of a signal from the first node, a signal from the gate line, a signal from the first voltage terminal and a signal from the second voltage terminal.

2. The display panel according to claim 1, wherein the plurality of display units includes at least three display units.

3. The display panel according to claim 2, wherein the at least three display units are sequentially arranged along an extending direction of a gate line of the display panel, or the at least three display units are arranged sequentially along an extending direction of a data line of the display panel.

4. The display panel according to claim 2, wherein display brightness of the at least three display units are different from each other in the bright state.

5. The display panel according to claim 2, wherein ratios of areas of the at least three display units to an area of the sub-pixel are the same.

6. The display panel according to claim 1, wherein each display unit includes liquid crystals, and a pixel electrode and a common electrode which are configured to drive the liquid crystals, and common electrodes of display units of the display panel are electrically connected to each other.

7. The display panel according to claim 1, wherein the storage circuit includes a first latch circuit, a second latch circuit, a latch control circuit and a driving control circuit;

the first latch circuit is coupled to the first node, the first voltage terminal, the second voltage terminal and the second latch circuit, and a point on a connecting line between the first latch circuit and the second latch circuit is set as a second node; the first latch circuit is configured to transmit a signal from the first voltage terminal or a signal from the second voltage terminal to the second node under control of a signal from the first node;

the second latch circuit is coupled to the second node, the first voltage terminal, the second voltage terminal and the latch control circuit, and is configured to transmit a signal from the first voltage terminal or a signal from the second voltage terminal to the latch control circuit under control of a signal from the second node;

the latch control circuit is further coupled to the gate line and the first node, and is configured to transmit a signal from the second latch circuit to the first node under control of a signal from the gate line;

the driving control circuit is coupled to the first node, the second node, the third voltage terminal, the fourth voltage terminal and the pixel electrode, and is configured to transmit a signal from the fourth voltage terminal to the pixel electrode under control of a signal from the first node or transmit a signal from the third voltage terminal to the pixel electrode under control of a signal from the second node.

8. The display panel according to claim 7, wherein the data input circuit includes a first transistor, a gate of the first transistor is coupled to the gate line, a first electrode of the first transistor is coupled to the data line, and a second electrode of the first transistor is coupled to the first node.

9. The display panel according to claim 8, wherein the latch control circuit includes a sixth transistor, a gate of the sixth transistor is coupled to the gate line, and a second electrode of the sixth transistor is coupled to the first node, wherein the first transistor and the sixth transistor are mutually N-type and P-type transistors.

10. The display panel according to claim 9, wherein the second latch circuit includes a fourth transistor and a fifth transistor, and the fourth transistor and the fifth transistor are mutually N-type and P-type transistors;

a gate of the fourth transistor is coupled to the second node, a first electrode of the fourth transistor is coupled to the first voltage terminal, and a second electrode of the fourth transistor is coupled to the first electrode of the sixth transistor;

a gate of the fifth transistor is coupled to the second node, a first electrode of the fifth transistor is coupled to the second voltage terminal, and a second electrode of the fifth transistor is coupled to the first electrode of the sixth transistor.

11. The display panel according to claim 7, wherein the first latch circuit includes a second transistor and a third transistor, the second transistor and the third transistor are mutually N-type and P-type transistors;

a gate of the second transistor is coupled to the first node, a first electrode of the second transistor is coupled to the first voltage terminal, and a second electrode of the second transistor is coupled to the second node;

a gate of the third transistor is coupled to the first node, a first electrode of the third transistor is coupled to the second voltage terminal, and a second electrode of the third transistor is coupled to the second node.

12. The display panel according to claim 7, wherein the driving control circuit includes a seventh transistor and an eighth transistor;

a gate of the seventh transistor is coupled to the second node, a first electrode of the seventh transistor is coupled to the third voltage terminal, and a second electrode of the seventh transistor is coupled to the pixel electrode;

a gate of the eighth transistor is coupled to the first node, a first electrode of the eighth transistor is coupled to the fourth voltage terminal, and a second electrode of the eighth transistor is coupled to the pixel electrode.

13. The display panel according to claim 1, wherein each driving sub-circuit is configured to drive a corresponding one of the plurality of display units to display one brightness in the bright state.

14. A display apparatus, comprising the display panel according to claim 1.

15. A driving method for the display apparatus according to claim 14, the method comprising:

scanning sub-pixels of the display apparatus row by row;

inputting voltage signals that are not completely the same to fourth voltage terminals and the data lines coupled to driving sub-circuits corresponding to display units in each sub-pixel of a row of sub-pixels in response to a scanning of the raw of sub-pixels, so that display brightness of at least two of the display units in the bright state are different, wherein each display unit includes liquid crystals, and a pixel electrode and a common electrode which are configured to drive the liquid crystals, and the driving method further comprises:

inputting an alternating voltage to the common electrode, wherein a difference value between a voltage input from the third voltage terminal and the alternating voltage is 0; and inputting alternating voltages to fourth voltage terminals coupled to the driving sub-circuits respectively, wherein differences between the voltages input to the fourth voltage terminals and the alternating voltage of current input to the common electrode are not completely equal.

* * * * *